US006868555B2

(12) United States Patent
Zic et al.

(10) Patent No.: US 6,868,555 B2
(45) **Date of Patent: *Mar. 22, 2005**

(54) DEVICE AND METHOD OF USE FOR CONVERTING STYLE OF CLOTHING AND DECORATING CLOTHING

(76) Inventors: Doreen Theresa Zic, 403 Oregon La., Boca Raton, FL (US) 33487; John Raymond Hock, 403 Oregon La., Boca Raton, FL (US) 33487

( * ) Notice: Subject to any disclaimer, the term of this patent is extended or adjusted under 35 U.S.C. 154(b) by 0 days.

This patent is subject to a terminal disclaimer.

(21) Appl. No.: 10/306,578

(22) Filed: Nov. 27, 2002

(65) Prior Publication Data

US 2003/0196239 A1 Oct. 23, 2003

Related U.S. Application Data

(63) Continuation-in-part of application No. 10/215,932, filed on Aug. 10, 2002, now Pat. No. 6,785,910

(60) Provisional application No. 60/374,580, filed on Apr. 23, 2002, and provisional application No. 60/416,734, filed on Oct. 8, 2002.

(51) Int. Cl.[7] ..... A41F 1/00; A41D 7/00

(52) U.S. Cl. ..... 2/67; 2/326

(58) Field of Search ..... 2/67, 69, 244, 2/246, 336, 338, 73, 78.1, 78.4, 227, 217, 228, 238, 400, 403, 406, 323–326, 341, 342, 271, 269, 243.1, 109–112, 105, 106, 113–115, 96, 125, 126; 24/3.1, 4, 3.13, 71 SD, 68 J; 223/111; D2/704, 705, 731, 625, 633–635, 639, 640; 63/3, 4, 9, 10, 12; 450/1, 86, 88, 28, 63, 64, 69, 71, 78

(56) References Cited

U.S. PATENT DOCUMENTS

| | | | | | |
|---|---|---|---|---|---|
| 863,970 | A | * | 8/1907 | Ebersole | 2/323 |
| 1,457,350 | A | * | 6/1923 | Damiano | 450/86 |
| 1,491,578 | A | * | 4/1924 | Ballou et al. | 450/86 |
| 1,628,278 | A | * | 5/1927 | Schever | 63/3 |
| 3,052,891 | A | * | 9/1962 | Panepinto | 2/323 |
| 3,456,457 | A | * | 7/1969 | Cass | 63/3 |
| 3,654,630 | A | * | 4/1972 | Block | 2/67 |
| 4,028,740 | A | * | 6/1977 | Luerken | 2/67 |
| 6,081,925 | A | * | 7/2000 | Reiber | 2/125 |
| 6,240,560 | B1 | * | 6/2001 | DeCaro | 2/67 |
| 6,279,171 | B1 | * | 8/2001 | Brancato | 2/326 |

* cited by examiner

*Primary Examiner*—Gloria M. Hale
(74) *Attorney, Agent, or Firm*—Yi Li

(57) ABSTRACT

A device and methods for converting and decorating clothing are disclosed. The device includes a center connection part, and a plurality of extensions, each with one end connected to the center connection part and with another end connected to an attachment structure. The method includes attaching one or more first extensions of the device to one or more first locations of a clothing and attaching one or more second extensions to one or more second locations of the clothing to convert the clothing from one style to another style, or to decorate the clothing. Also disclosed is a multifunctional jewelry piece which can be used to convert a style of clothing, to provide ornamentation to clothing, and to provide ornamentation to a person's body.

18 Claims, 12 Drawing Sheets

DEVICE AND METHOD OF USE FOR CONVERTING STYLE OF CLOTHING AND DECORATING CLOTHING

CROSS REFERENCE TO RELATED APPLICATION

This application is a Continuation-In-Part of Non-Provisional Patent Application Ser. No. 10/215,932, filed Aug. 10, 2002 now U.S. Pat. No, 6,785,910, which claims priority of Provisional Patent Application Ser. No. 60/374,580, filed Apr. 23, 2002; and is Non-Provisional Patent Application of Provisional Application Ser. No. 60/416,734, filed Oct. 8, 2002.

FIELD OF THE INVENTION

The present invention relates in general to clothing accessories, and more particularly to a device which enables converting a style of clothing, decorating clothing or a person's body.

BACKGROUND OF THE INVENTION

Thong-type bikini swimsuit bottoms and briefs are known in the art. They are particularly suitable for sun tanning because of large areas of body exposure. However, extensive body exposures can also be embarrassing to many users when walking around in a public area, such as at a beach or a resort.

On the other hand, one-piece swimsuits or bikini swimsuits have less body exposures. It is more comfortable to wear one-piece or bikini swimsuits at a beach or at a pool party. However, when the swimsuit wearer is exposed to the sun or the lamps of a tanning booth, these types of swimsuits will leave a white outline of the shape of the garment. The white outline will often be seen when the person wears a swimsuit or other piece of clothing having a shape different from the one used to obtain the tan.

Therefore, because of the above-described reasons, it is desirable to have different types of swimsuits and to select the appropriate one for a specific purpose and occasion. However, this can be costly and inconvenient. Particularly with a two-piece bikini swimsuit, the top portion already provides a sufficient body exposure. To obtain sun tan around the buttocks, one needs to change to a thong style swimsuit.

U.S. Pat. No. 6,240,560 (to DeCaro) discloses a versatile swimsuit with accessories, which utilizes a band wrap at selected areas to change the shape of a bikini top, adjust the cut, and style of a swimsuit. More particularly, DeCaro teaches using a band wrap to wrap the rear panel of a swimsuit together to provide a thong style like swimsuit. The band wrap is made of a flexible material including elastic between the opposing inner and outer fabric panel. However, although using a band wrap to wrap a small area may be feasible, to wrap an entire rear panel into a tubular band wrap can be difficult and uncomfortable. Furthermore, the band wrapped rear panel has a poor appearance, which will affect negatively on a user's interest.

Based on the above discussion, it is apparent that it is desirable to have a swimsuit accessory device which enables a convenient conversion of a conventional or a bikini swimsuit style to a thong style as needed. Furthermore, it is also desirable to have a device which is able to convert the front panel of a swimsuit to a style having more body exposure for the purpose of sun tanning.

Such a need is not only present for swimsuits, it is also desirable to have the device applicable to panties so that the conversion can be made conveniently in a private environment.

Moreover, it is further desirable to have a device which is not only able to convert the style of a bottom panel of a swimsuit or panties, it is also able to convert the style of a top panel of a swimsuit, or a tube top, or a bra.

Additionally, it is also desirable to have a multifunctional device which enables converting the style of clothing and also decorating the clothing.

SUMMARY OF THE INVENTION

In one embodiment, the present invention is directed to a device for converting a style of clothing. The device comprises a center connection means, and a plurality of extensions, each extension having a first end portion being connected to the center connection means and a second end portion being connected to an attachment means.

In a further embodiment, the present invention is directed to the method of use of the device for converting a style of clothing. The method includes attaching one or more extensions by attachment means to one or more first locations of the clothing, and attaching one or more second extensions by the attachment means to one or more second locations of the clothing, whereby a portion of said clothing between said extensions is tightened, causing a conversion of said clothing from one style to another style.

In another embodiment, the present invention is further directed to a method of decorating clothing. The method includes attaching one or more first extensions by attachment means to one or more first locations of the clothing, and attaching one or more second extensions by the attachment means to one or more second locations of the clothing to provide decoration of the clothing.

In another embodiment, the present invention is directed to a multifunctional jewelry piece, which includes a center connection means, and a plurality of extensions, each extension having a first end portion being connected to the center connection means and a second end portion being connected to an attachment means. The multifunctional jewelry piece can be used to convert a style of clothing, to provide ornamentation to clothing, and to provide ornamentation to a person's body.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
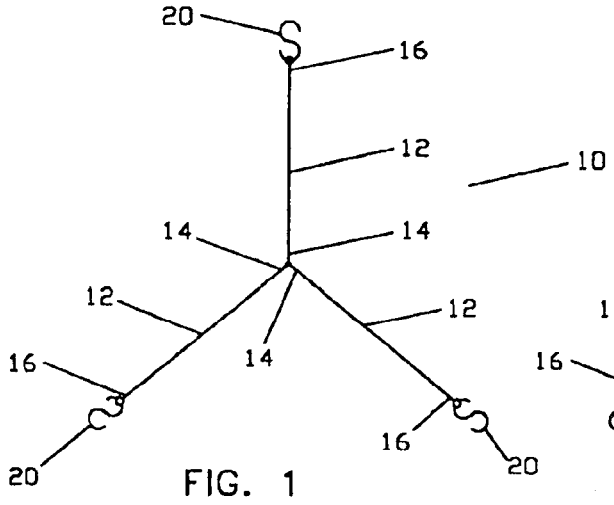
FIG. 1 is an illustrative drawing of the device of one embodiment of the present invention.

Referring now to the drawings, FIG. 1 shows one example of one embodiment of the device of the present invention. The device 10 comprises a plurality of extensions 12, first end portions 14 of extensions 12 being connected together; and an attachment means 20 being connected to a second end portion 16 of each extension 12.

Figure 2:
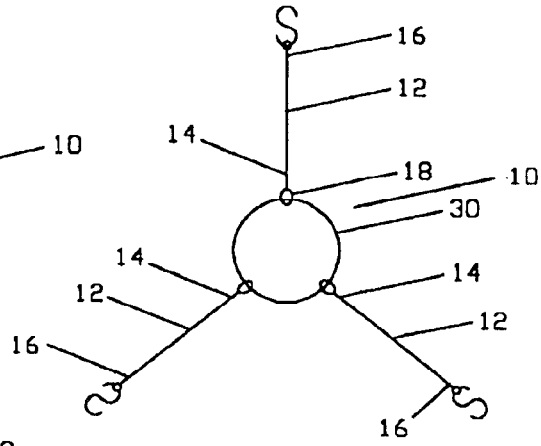
FIG. 2 is an illustrative drawing of the device with a circular center connection means of one embodiment of the present invention.

In a more preferred embodiment as shown in FIG. 2, device 10 comprises a center connection means 30; and a plurality of extensions 12, a first end portion 14 of each extension 12 being connected to center connection means 30; and an attachment means 20 being connected to second end portion 16 of each extension 12.

Figure 3:
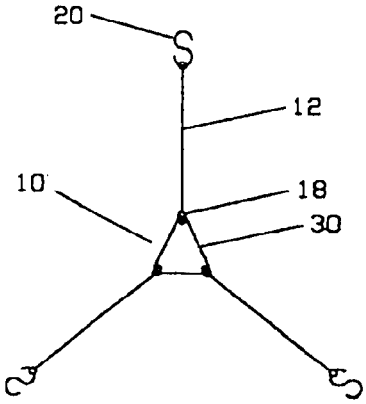
FIG. 3 is an illustrative drawing of the device with a triangular center connection means of one embodiment of the present invention.
Figure 4:
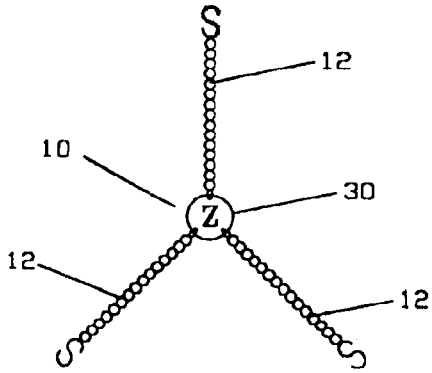
FIG. 4 is an illustrative drawing of the device with a decorative center connection means and extensions of one embodiment of the present invention.

The center connection means 30 can be in various shapes, such as a circular ring as shown in FIG. 2, a triangular ring as shown in FIG. 3, or other suitable shapes. As shown in FIG. 4, center connection means 30 can be a circular plate with a plurality of apertures around the periphery of the circular plate for connecting with a plurality of extensions 12. Furthermore, center connection means 30 can have various sizes. Additionally, center connection means 30 can be decorative with printings, such as designer logos, brand names or cartoon characters; or decorative with patterns.

The center connection means 30 can be made of a variety of materials. Suitable examples include metal, plastic, rubber and fabric.

The extension 12 can be connected directly to center connection means 30, for example tied on, welded on, or through an additional connection ring 18 as shown in FIGS. 2 and 3. With connection ring 18, extension 12 can be moved freely around center connection means 30, which provides flexibility in adjusting attachment positions.

Extension 12 can be chains, strips, strings, connected beads, connected loops. They can be made of variety of materials, including metal, plastic, rubber, fabric, elastic material, string, and beads. Extension 12 can also be decorative, with colors, decorative patterns, and decorative material surfaces. FIG. 4 shows extensions 12 made of stringed beads, and with a designer logo printed on the surface of center connection means 30. With decorative designs, the device of the present invention can be made like jewelry, which will not only service as a swimsuit accessory for style conversion, but also function as swimsuit decoration.

Figure 9A:
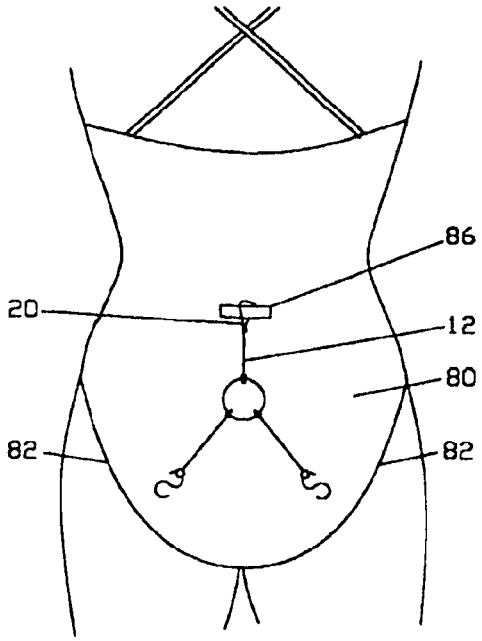
FIG. 9A shows the device with one attachment means attached to a loop on the rear panel of a one-piece swimsuit.

The attachment means 20 can be hooks, buttons, clasps, clamps, snaps, hook and loop fastener, or other suitable means. The plurality of attachment means 20 in one device can be the same, and can also be different. FIGS. 1 to 5 show illustrative examples of attachment means 20 as S-shape hooks. In FIG. 9A, one of attachment means, attached to loop 86 of the swimsuit, is a hook and loop fastener attachment.

Figure 6A:
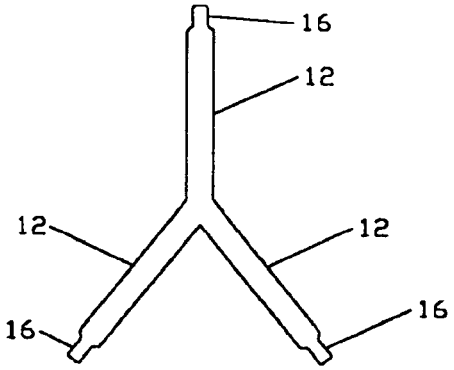
FIGS. 6A and 6B show the device with foldable extensions of one embodiment of the present invention.
Figure 6B:
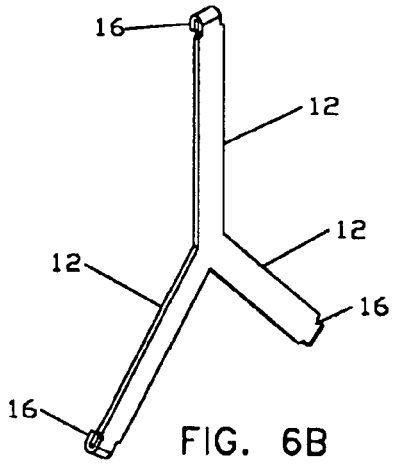

In an alternative embodiment, extensions 12 are made of foldable material such as aluminum strip. With this type of extension, no additional attachment means are required. The second end portion 16 itself can function as an attachment means, as shown in FIGS. 6A and 6B.

Figure 7A:
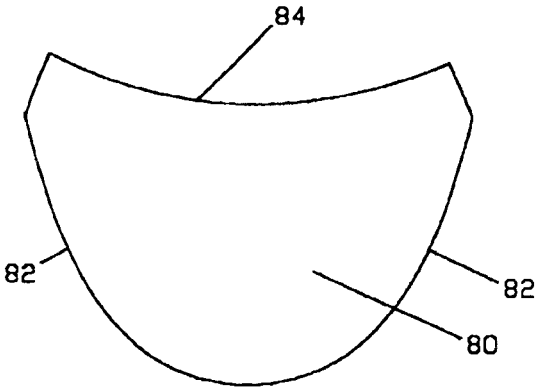
FIG. 7A shows a bottom rear panel of a bikini swimsuit.
Figure 7B:
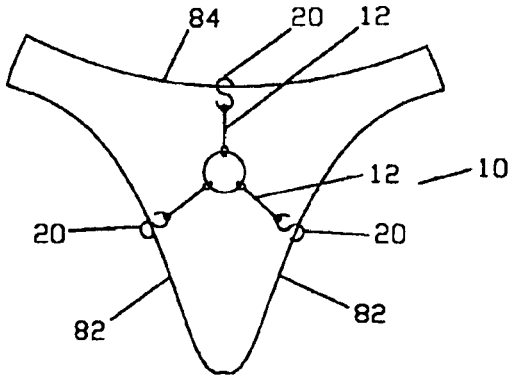
FIG. 7B shows the bottom rear panel of the bikini swimsuit of FIG. 7A after being converted to a thong style by applying the device of the present invention.
Figure 11A:
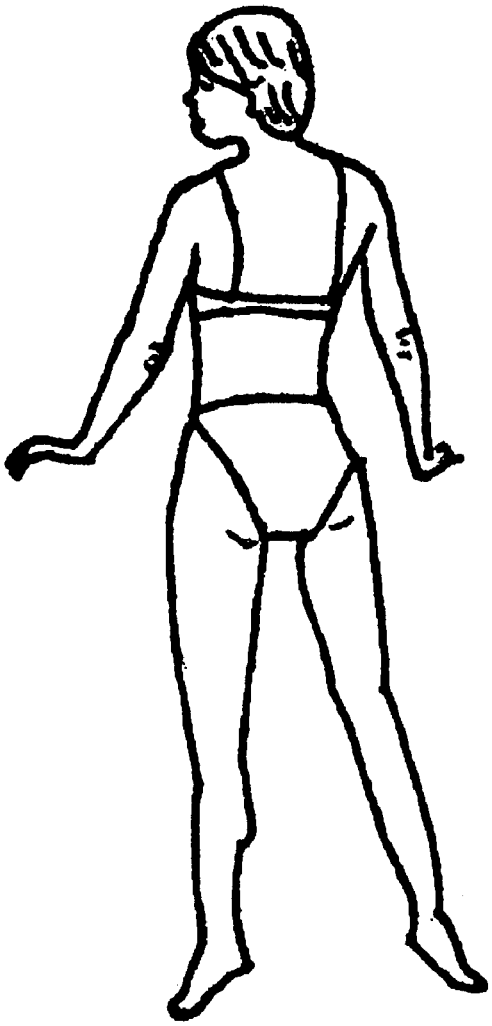
FIGS. 11A and 11B illustrate the application of the device of present invention to convert a swimsuit from a bikini style to a thong style.
Figure 11B:
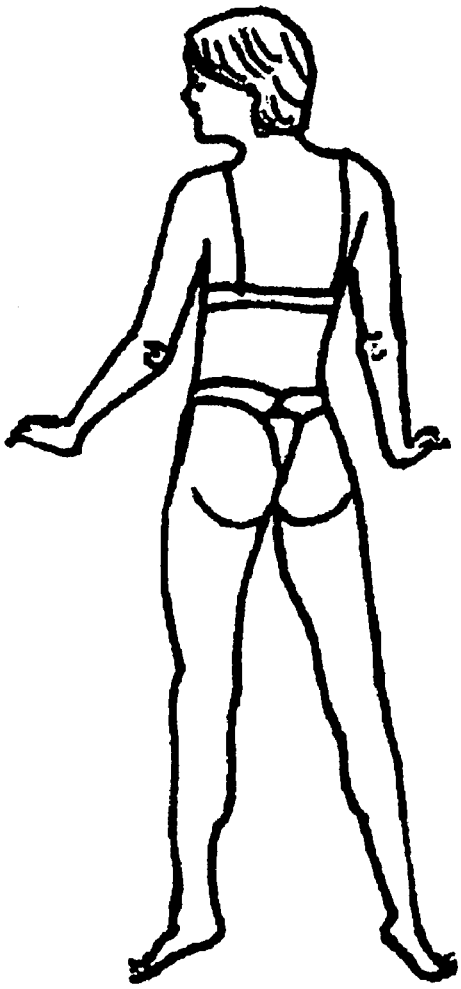

When in use, a swimsuit wearer attaches two extensions 12 of device 10 through attachment means 20 to two sides 82 of a bottom rear panel 80 of a swimsuit, as shown in FIG. 7B, and attaches one or more extensions 12 through attachment means 20 to one or more locations around the waist portion of the swimsuit, such as top edge 84 of rear panel 80 in FIG. 7B. The two extensions 12 attached to two sides 82 pull the swimsuit bottom rear panel together and hold rear panel 80 around the center, which converts a bikini or conventional style to a thong style, as illustrated in FIGS. 11A and 11B with the swimsuit on a user's body before and after the conversion. Therefore, using the device of the present invention, one can conveniently convert a rear panel of a swimsuit to a shape which provides more body exposure for sun tanning.

Figure 8:
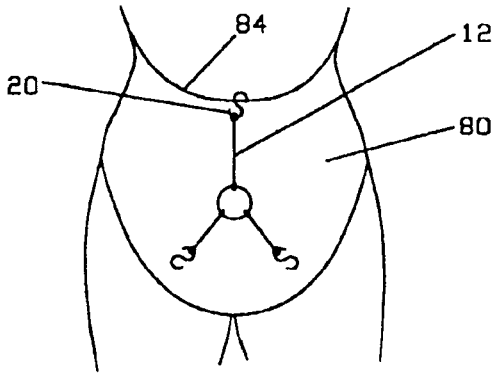
FIG. 8 shows the device having one attachment means attached to the top edge of the bottom rear panel of a one-piece swimsuit.
Figure 9B:
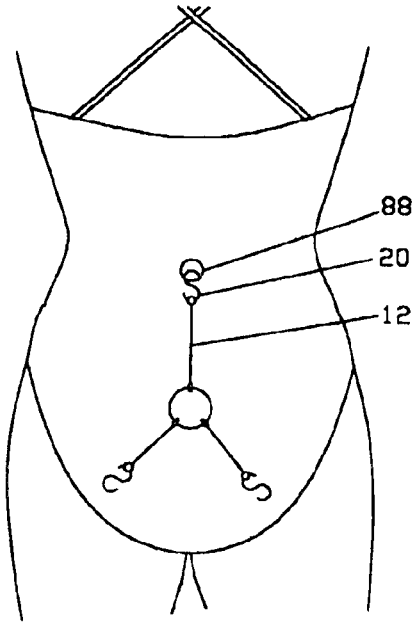
FIG. 9B shows the device with one attachment means attached to an attachment opening on the rear panel of a one-piece swimsuit.

FIGS. 7A and 7B illustrate the use of device 10 of the present invention to convert a rear panel of a two-piece bikini swimsuit to a thong style. The device of the present invention can also be used for converting a one-piece swimsuit. FIG. 8 shows a one-piece swimsuit which has a low back cut. As shown, one of extension 12 of device 10 can be attached to top edge of rear panel 80, similar to the use with bikini swimsuit shown in FIG. 7B. FIGS. 9A and 9B show that a one-piece swimsuit can have a built-in attachment location for use with the device of the present invention. In FIG. 9A, a one-piece swimsuit has a loop 86 around the waist portion on rear panel 80. In FIG. 9B, a one-piece swimsuit has an attachment hole 88 around the waist portion of rear panel 80, and attachment hole 88 can further be decorated. As shown, one of extension 12 can be attached to loop 86, or attachment hole 88, and two extensions 12 can be attached to the two sides 82 of rear panel 80 as illustrated previously.

Figure 12:
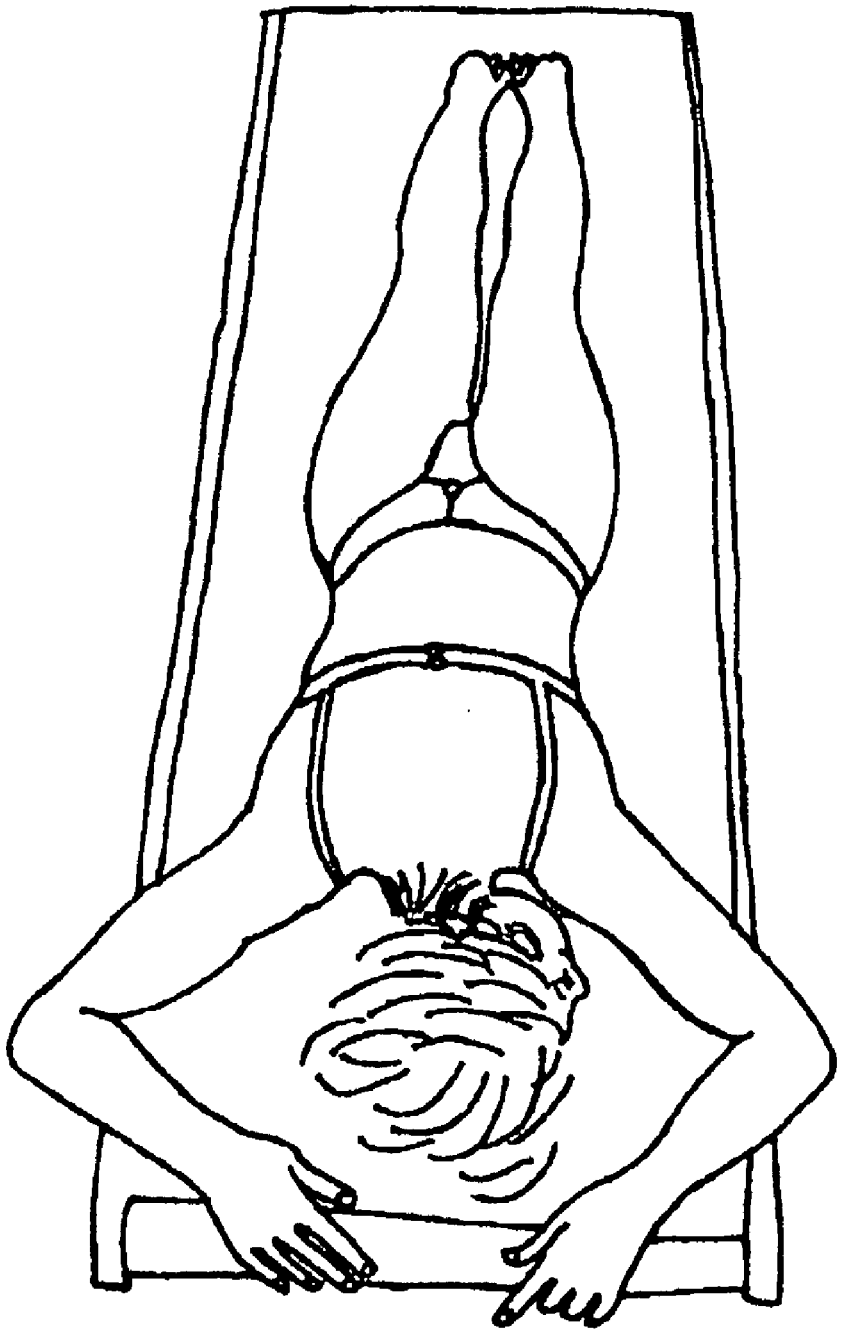
FIG. 12 illustrates one intended use of the device of present invention for sun bathing.

FIGS. 11A and 11B illustrate an example of using the device of the present invention to convert the bottom rear panel of a bikini swimsuit into a thong. FIG. 12 further illustrates the intended use of the device of the present invention for sun bathing. As shown in FIGS. 11B and 12, the maximum length from one of the attachment means to another of the attachment means of the device only enables the device to be attached to one side of a user's body, such that attaching one extension by attachment means to the waist portion of the bottom rear panel of the bikini, and attaching two extensions by said attachment means to two sides of the rear panel cause a substantial dimension change of the rear panel between the two sides, and therefore, convert the bottom rear panel from one style to another style.

Figure 5:
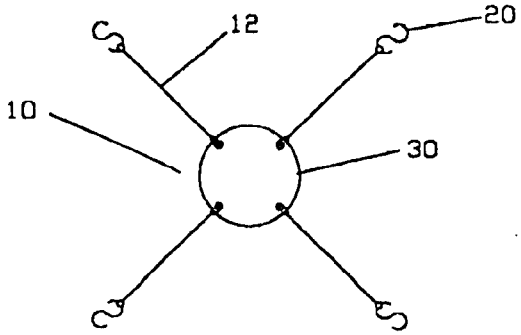
FIG. 5 is an illustrative drawing of the device with four extensions of one embodiment of the present invention.
Figure 10:
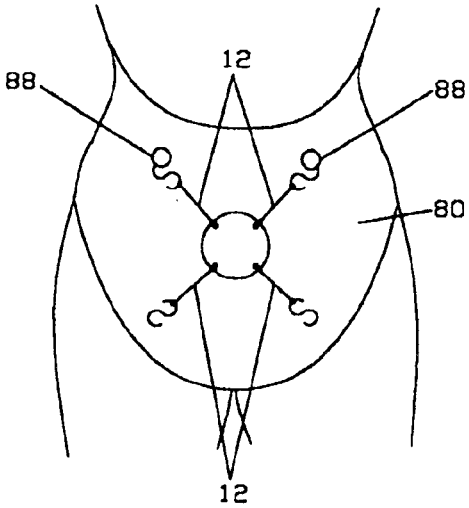
FIG. 10 shows the device with two attachment means attached to two attachment openings on the rear panel.

The devices shown in FIGS. 1 to 4, FIGS. 6 to 9 and FIG. 12 have three extensions 12. However, more than three extensions can be utilized for the purpose of the present invention, as shown in FIGS. 5 and 10. The length of each extension 12 can be the same, and can also be different, depending on the configuration of the swimsuit. For example, the extension attached to top edge 84 of rear panel 80, or loop 86 can be longer than the extensions attached to two sides 82 of rear panel 80, if top edge 84 or loop 86 has a relatively higher position.

Figure 13A:
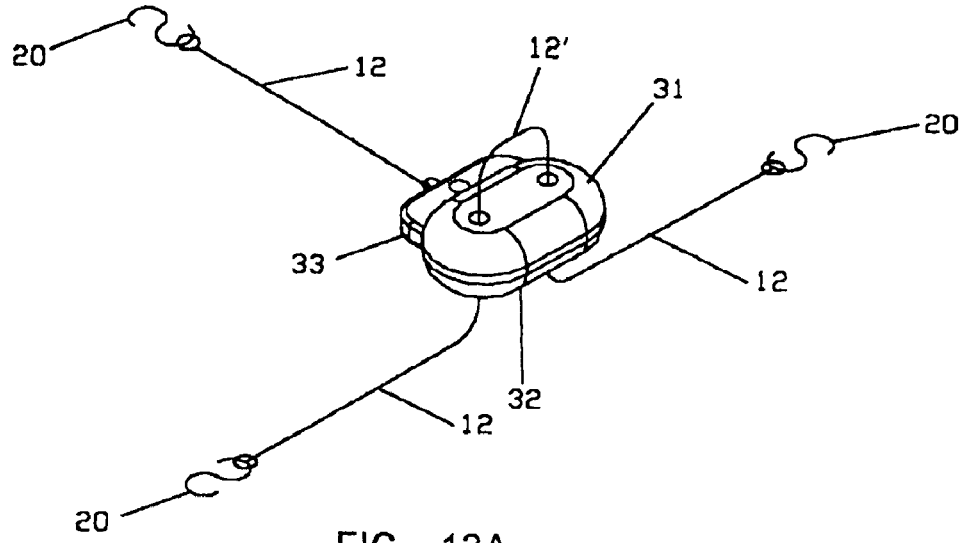
FIGS. 13A and 13B are two prospective views of an adjustable device of one embodiment of the present invention.
Figure 13B:
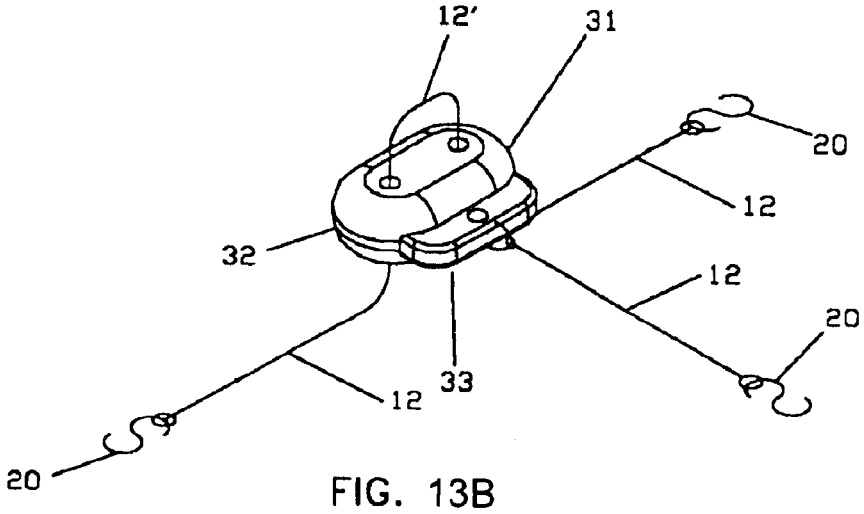

In a further embodiment, the present invention provides an adjustable center connection means 31 which has an adjustment mechanism for adjusting the length of extension 12. FIGS. 13A and 13B show an example of an adjustable device. In this case, two extensions 12 for attaching two sides of a swimsuit are connected together by an extension connector 12'. As shown, adjustable center connection means 31 has a holder 32 with two apertures housing extension connector 12', and spring loaded slide plate 33 inserted inside holder 32. With this device, a user can push in slide plate 33 and pull extension connector 12' to adjust the lengths of extensions 12 based on the swimsuit size, style, and user's individual needs. Other suitable adjustment means can also be utilized for the purpose of the present invention.

Figure 14B:
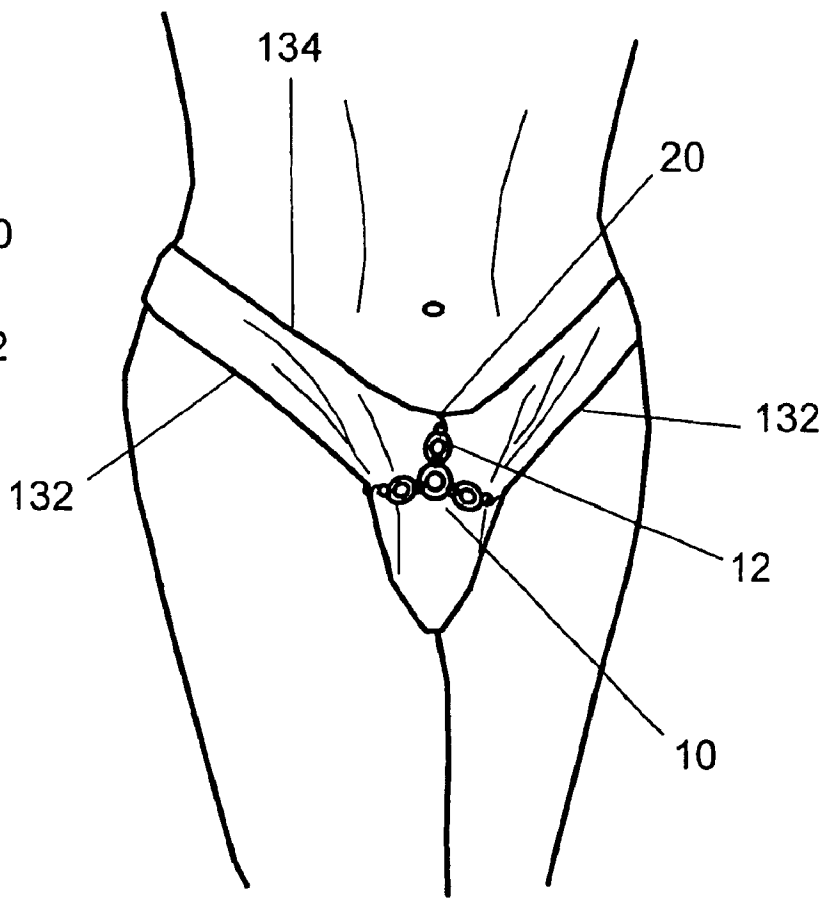
FIG. 14A shows a bottom front panel of a bikini swimsuit and FIG. 14B shows the bottom front panel of the bikini swimsuit of FIG. 14A after being converted by applying the device of the present invention to a style having more body exposure.
Figure 14A:
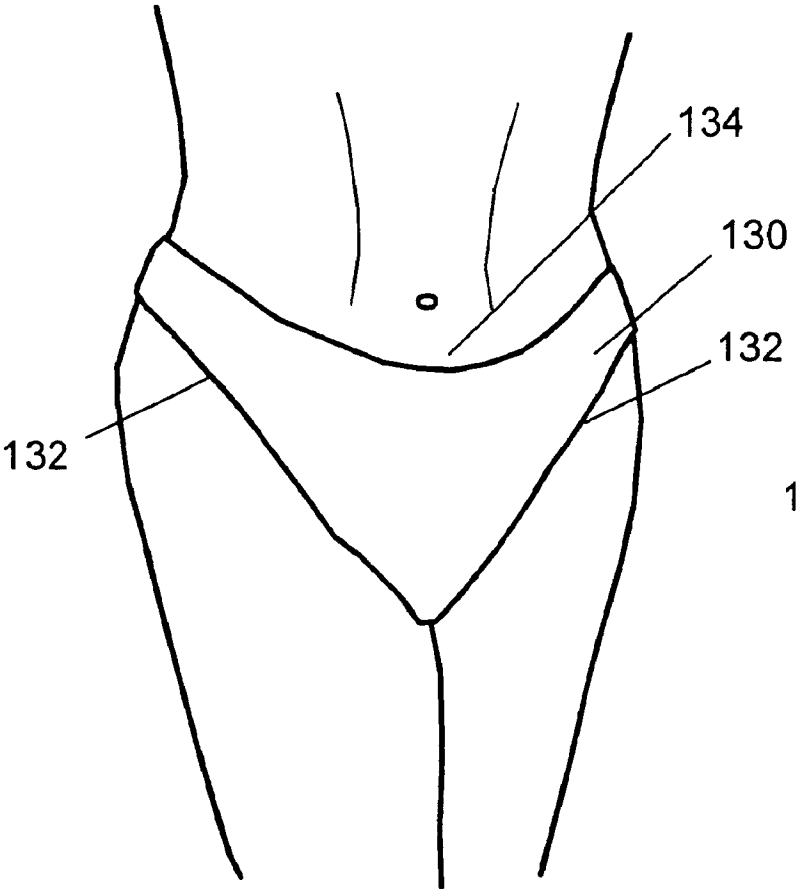

The device 10 of the present invention can also be used to convert the front bottom panel of a bikini or panties to a style which has more body exposure, as illustrated in FIGS. 14A and 14B. In FIGS. 14A and 14B, and several other examples hereinafter, extension 12 is made of metal rings.

Furthermore, device 10 of the present invention can be utilized to convert the styles of panties, in addition to swimsuits. In a similar manner as previously described for converting the style of the bottom panel of a swimsuit, device 10 can be attached to the rear or front panel of panties to convert the panties to a style having more body exposure.

Figure 15B:
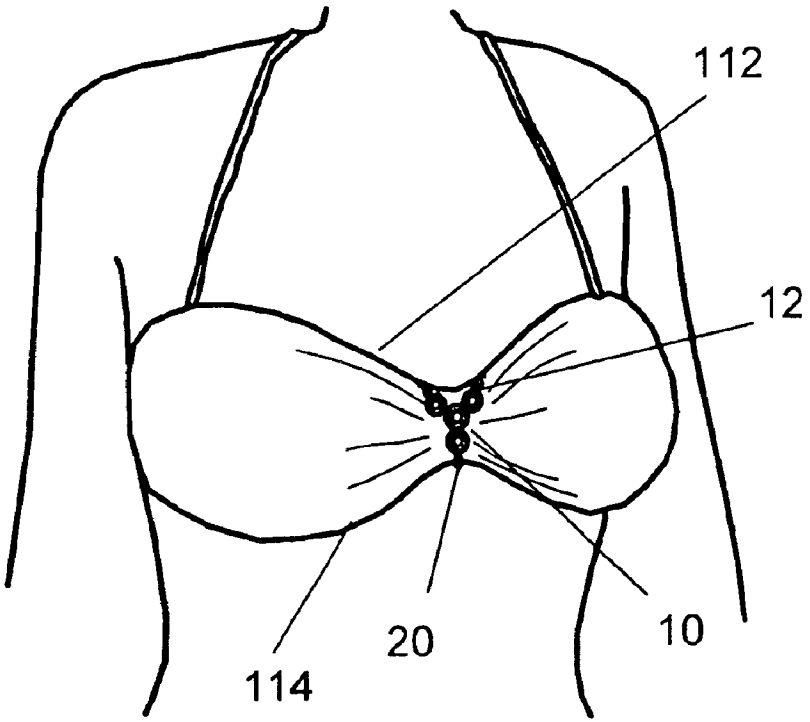
FIG. 15A shows a tube top and FIG. 15B shows the tube top of FIG. 15A after being converted, by applying the device of the present invention, to a cup shape.
Figure 15A:
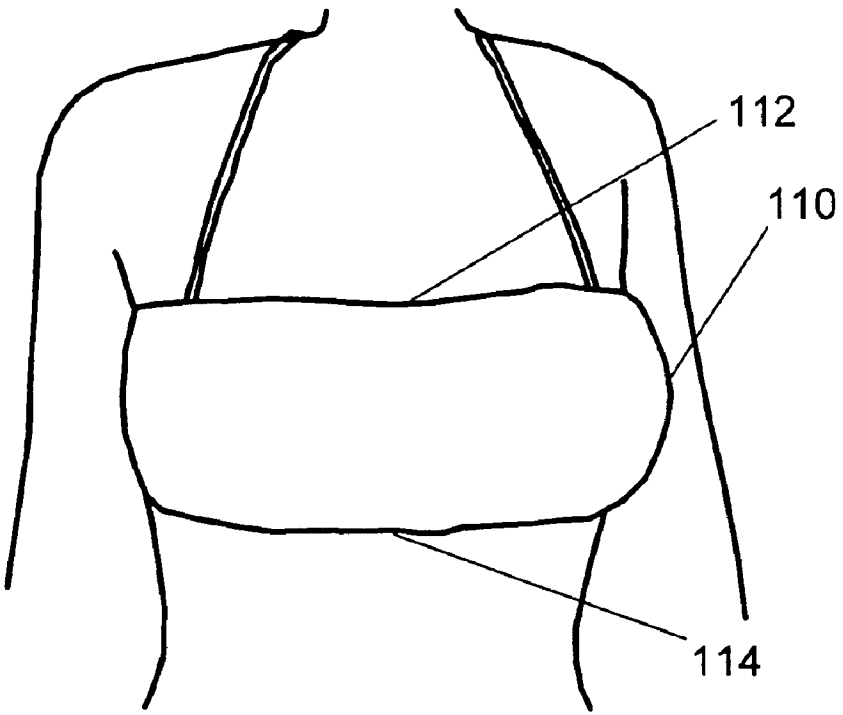

In a further embodiment, device 10 of the present invention can be used to convert the style of the top panel of a bikini, a tube top, or a bra having a flat front panel without cups. As shown in FIGS. 15A and 15B, attaching two extensions 12 to top edge 112 of a tube top 110 and another extension 12 to bottom edge 114 of tube top 110 converts tube top 110 to a style having reduced center portion, which has more body exposure, and also a decorative shape. FIG. 15B shows three extensions 12 of device 10 being used for the conversion. However, if only two extensions 12 are used, one attached to the top edge and one attached to the bottom edge, the same conversion can also be achieved.

Figure 20:
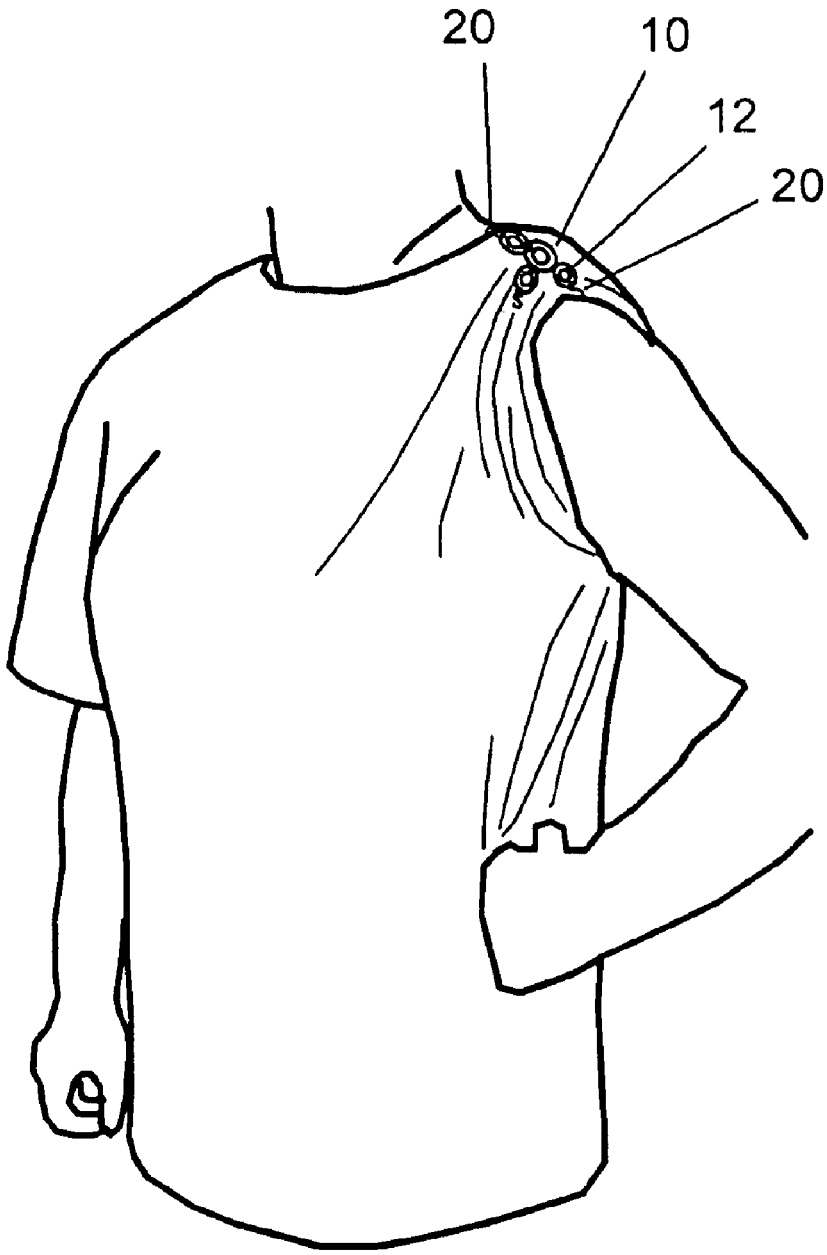
FIG. 20 illustrates using the device of the present invention to convert a T-shirt to a tank top style.

Furthermore, device 10 of the present invention can also be used to convert styles of other clothing. As an example, FIG. 20 shows a conversion of a regular T-shirt to a tank top style using device 10. As shown, two extensions 12 are used for the conversion. It is apparent that a third or a forth extension can also be utilized for the conversion if desired.

Therefore, based on the above descriptions, the present invention provides, in general, a method of converting clothing using the device of the present invention. The method comprises the steps of attaching device 10 by one or more first extensions 12 by attachment means 20 to one or more first locations of a clothing; and attaching one or more second extensions 12 by the attachment means 20 to one or more second locations of the clothing, whereby a portion of the clothing between the attached extensions is tightened, which results in a conversion of the clothing from one style to another style. Herein, the first and second extensions can be the same, and can also be different as described previously. Furthermore, the one or more first locations can be the same or different. Similarly, the one or more second locations can be the same or different. Moreover, the clothing includes top and bottom panels of a swimsuit, bra, panties, T-shirts and outerwear.

The device of the present invention provides a swimsuit wearer an ability to conveniently change a conventional style swimsuit, more suitable in a public environment, into a shape with more body exposures for sun bathing and sun tanning. Therefore, the present invention provides a practical solution for easy conversion of swimsuit styles between different environments. Furthermore, it costs much less to use the devices of the present invention to convert swimsuit styles than possessing multiple swimsuits of different styles.

The device of the present invention can be sold as an after-market product for use with user's existing swimsuit, and it can also be sold together with a swimsuit as an accessory or decoration. Moreover, because of its decorative feature, the device of the present invention can also be used as a decoration of a thong style swimsuit, where a conversion is not even required.

In another embodiment, the present invention provides a kit for making a device. The kit comprises extension materials, a plurality of attachment means, center connection means, and an instruction on how to make the device. Because of its structural simplicity, low cost, and decorative features, users can make various devices with their choices of color, material, and style. Using the kit a user can make devices with or without the center connection means, with three or more extensions, or with only two extensions.

In a further embodiment, the present invention provides a method of decorating clothing using the device of the present invention. The method comprises the steps of attaching device 10 comprising a center connection means 30, and a plurality of extensions 12, first end portions of extensions 12 being connected to center connection means 30, a second end portion of each of extensions 12 being connected to an attachment means 20, by one or more extensions 12 by attachment means 20 to one or more first locations of clothing, and attaching one or more extensions 12 by attachment means 20 to one or more second locations of the clothing to provide a decoration of the clothing. The clothing includes top and bottom panels of a swimsuit, bra, panties, T-shirt and outerwear.

Figure 16:
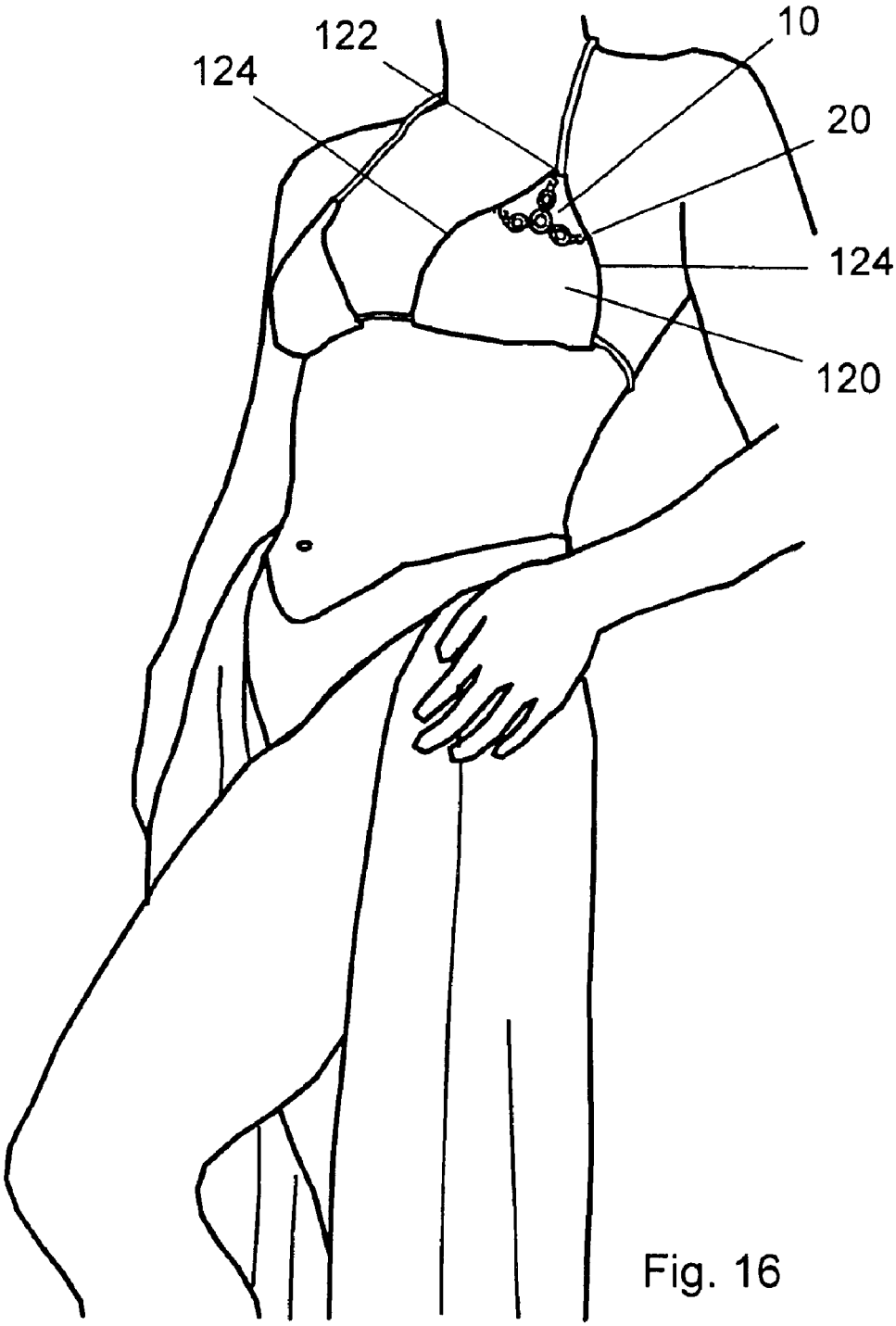
FIG. 16 illustrates the device of the present invention attached to a cup of a bikini swimsuit top for decorating the swimsuit.

FIG. 16 illustrates an example of using device 10 to decorate the top panel of a bikini or a bra. As shown, the device 10 has three extensions 12, one extension 12 being attached to the top 122 of cup 120 by attachment means 20, and two other extensions 12 being attached to the left and right side 124 of cup 120, respectively, by attachment means 20. The device 10 provides a beautiful and unique decoration of the bikini top.

Figure 18:
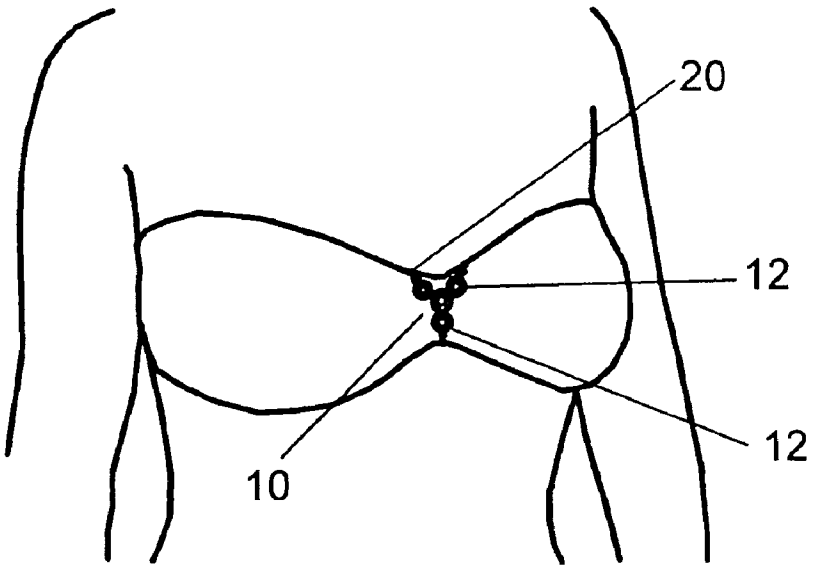
FIG. 18 illustrates the device of the present invention attached to the center of the top panel of a bikini swimsuit for decorating the swimsuit.

FIG. 18 shows another example of using device 10 to decorate the top panel of a bikini or a bra. As shown, the three extensions 12 are attached to the top and bottom edges around the center of the top panel of the bikini or a bra to provide ornamentation. Moreover, the device of the present invention can also be attached easily on various locations of a knitted sweater, cardigan, or other suitable outerwear for decorating the clothing.

Figure 17:
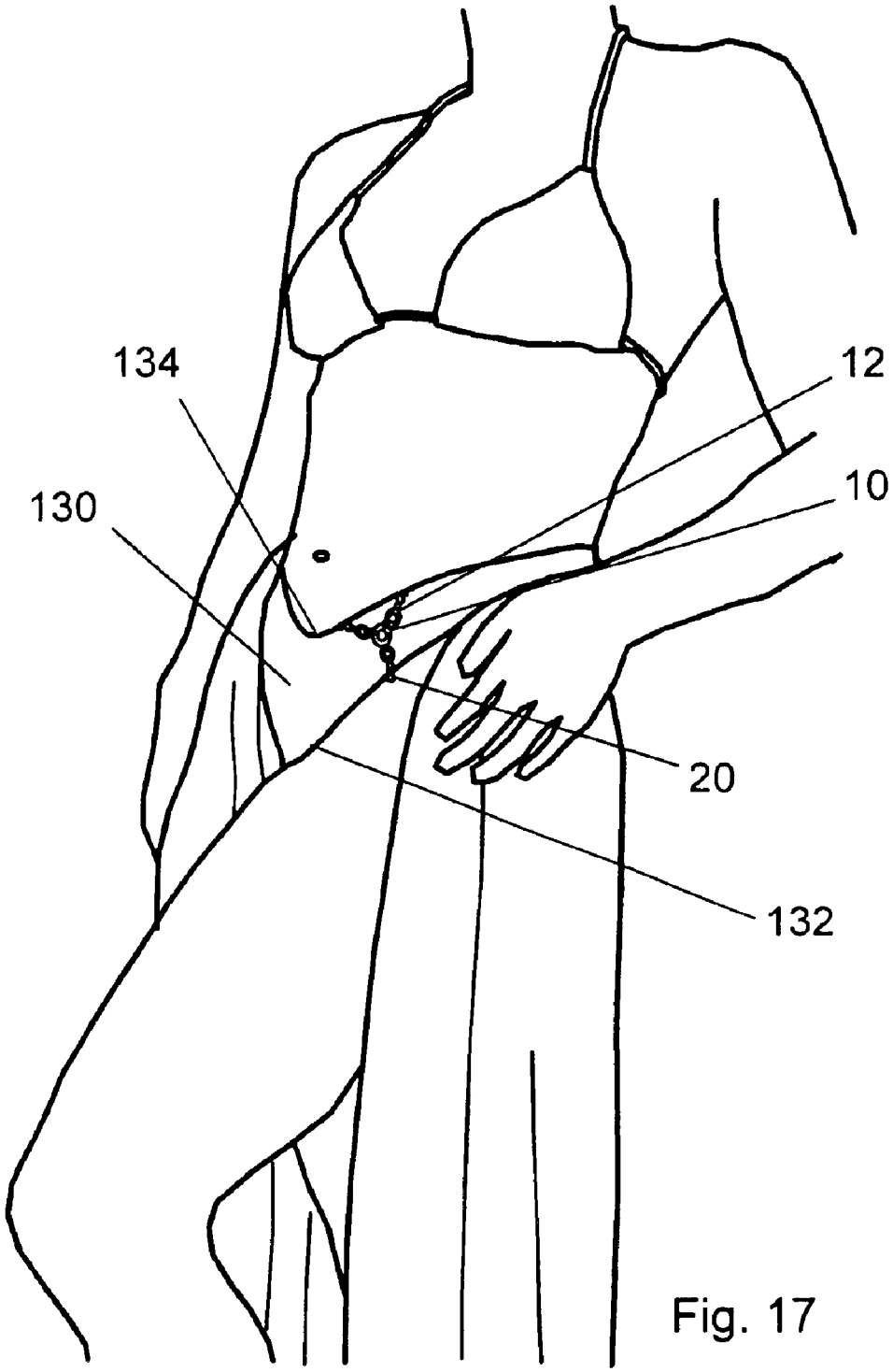
FIG. 17 illustrates the device of the present invention attached to the front bottom panel of a bikini swimsuit for decorating the swimsuit.

FIG. 17 illustrates an example of using device 10 to decorate the bottom panel of a bikini or panties. As shown, one extension 12 is attached to a side 132 of the front bottom panel 130 of a bikini by attachment means 20, and two other extensions 12 are attached to the waist portion 134 by attachment means 20. Once again, such an attachment of device 10 provides a unique decoration to the bikini bottom.

Additionally, attachments as shown in FIGS. 16 to 18, aside from its use for decorating clothing, also provide a storage of the device when it is not used for converting the shape or style of the swimsuit or lingerie. The unique decorations illustrated in FIGS. 16 to 18 create unprecedented new decorations to swimwears and lingerie.

Furthermore, the device of the present invention can be utilized as a jewelry piece such as a pendant, a part of a necklace, a part of a wrist bracelet, a part of a ankle lace, or an earring. Because of the multiple functionality of the device, the present invention has provided a multifunctional jewelry piece. Similarly, the multifunctional jewelry piece 10 comprises a center connection means 30, and a plurality of extensions 12, first end portions of extensions 12 being connected to center connection means 30, a second end portion of each of extensions 12 being connected to an attachment means 20, as shown in FIG. 2. The multifunctional jewelry piece 10 can further comprise a linkage means. The linkage means links one of plurality extensions 12 to another one of plurality of extensions 12.

Figure 19:
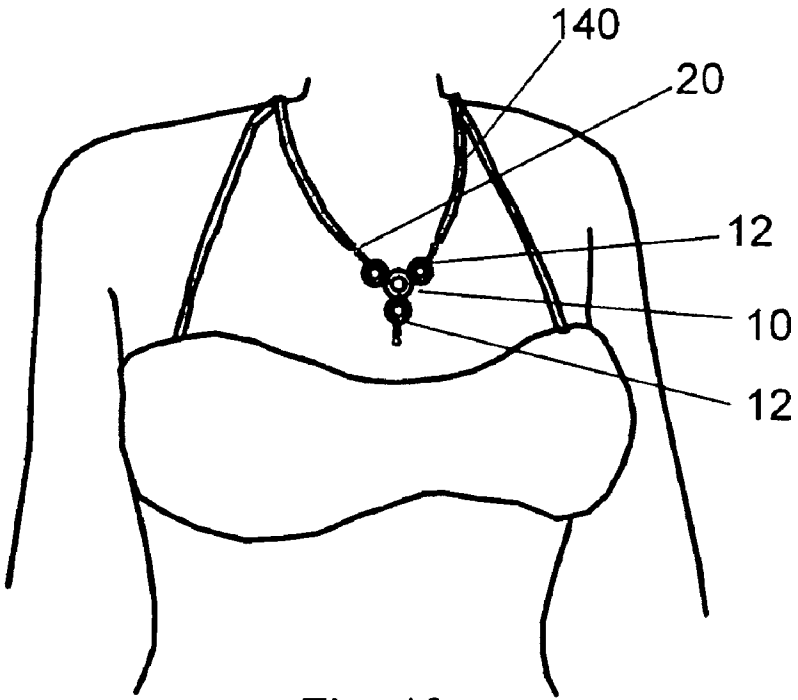
FIG. 19 illustrates the use of the device of the present invention as part of a necklace.

The multifunctional jewelry piece 10 can be used to convert a style of clothing, to provide ornamentation to clothing, and to provide ornamentation to a person's body. FIG. 19 illustrates an example which uses the multifunctional jewelry piece 10 as part of a necklace 140.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

We claim:

1. A device for converting a style of clothing comprising:

a center connection means, and a plurality of linear extensions extending radially from said center connection means, each said linear extension having a first end portion being connected to said center connection means and a second opposing end portion being connected to an attachment means, wherein a maximum length from one of said attachment means to another of said attachment means of said device only enables said device to be attached to one side of a user's body, such that attaching one or more first linear extensions by attachment means to one or more first locations of said clothing on one side of said user's body, and attaching one or more second linear extensions by said attachment means to one or more second locations of said clothing on said side of said user's body cause a substantial dimension change of a portion of said clothing between said one or more first locations and said one or more second locations thereby converting said clothing on said side of said user's body from one style to another style.

2. The device of claim 1, wherein said center connection means is a loop.

3. The device of claim 1, wherein said center connection means is a plate with a plurality of apertures positioned peripherally about said plate for connecting said plurality of linear extensions, said plurality of apertures spacing apart along said periphery of said plate.

4. The device of claim 1, wherein said attachment means is a hook.

5. The device of claim 1, wherein said device has three extensions.

6. The device of claim 1, wherein said clothing is panties, and said first and second locations are at a rear panel of said panties.

7. The device of claim 1, wherein said clothing is panties, and said first and second locations are at a front panel of said panties.

8. The device of claim 1, wherein said clothing is a bra, and said first and second locations are at a front portion of said bra.

9. A method of converting a style of clothing comprising the steps of:

(a) providing a device comprising a center connection means, and a plurality of linear extensions extending radially from said center connection means, each said extension having a first end portion being connected to said center connection means and a second opposing end portion being connected to an attachment means, wherein a maximum length from one of said attachment means to another of said attachment means of said device only enables said device to be attached to one side of a user's body.

(b) attaching one or more first of said plurality of linear extensions by said attachment means to one or more first locations of clothing on one side of a user's body, and (c) attaching one or more second of said plurality of linear extensions by said attachment means to one or more second locations of said clothing on said side of said user's body, thereby tightening a portion of said clothing between said one or more first locations and said one or more second locations, causing a substantial dimension change of said portion of said clothing, and resulting in a conversion of said clothing on said side of said user's body from one style to another style.

10. The method of converting a style of clothing of claim 9, wherein said clothing is selected from the group consisting of swimsuits, bras, panties, T-shirts and outerwear.

11. The method of converting a style of clothing of claim 10, wherein said first location is around rear waist portion of said swimsuit or said panties, and said second locations are at a left and a right side of rear bottom panel of said swimsuit or said panties, whereby said swimsuit or said panties is converted to a style having more body exposure.

12. The method of converting a style of clothing of claim 10, wherein said first location is around front waist portion of said swimsuit or said panties, and said second locations are at a left and a right side of front bottom panel of said swimsuit or said panties, whereby said swimsuit or said panties is converted to a style having more body exposure.

13. The method of converting a style of clothing or claim 10, wherein said first location is at a front bottom edge around center of said bra, and said second locations are at a front top edge around center of said bra, whereby said bra is converted to a shape having more body exposure, or decorative shape.

14. The method of converting a style of clothing of claim 10, wherein said first location is at a collar of a T-shirt, and said second location is at an edge of a sleeve of said T-shirt, whereby said T-shirt is converted to a tank top style.

15. A method of decorating clothing comprising the steps of:

(a) providing a device comprising a center connection means, and a plurality of linear extensions extending radially from said center connection means, first end portions of said linear extensions being connected to said center connection means, a second opposing end portion of each of said linear extensions being connected to an attachment means, wherein a maximum length from one of said attachment means to another of said attachment means of said device only enables said device to be attached to one side of a user's body, (b) attaching one or more first of said plurality of linear extensions through attachment means to one or more first location of clothing on one side of a user's body, and (c) attaching one or more second of said plurality of linear extensions through said attachment means to one or more second locations of said clothing on said side of said user's body to provide a decoration of said clothing.

16. The method of decorating clothing of claim 15, wherein said clothing is selected from the group consisting of swimsuits, bras, panties, T-shirts and outerwear.

17. The method of decorating clothing of claim 16, wherein said first location is at a top of a cup of said swimsuit or said bra, and said second locations are two sides of said cup of said swimsuit or said bra.

18. The method of decorating clothing of claim 16, wherein said first location is at a left or a right side of a front panel of a bikini bottom or said panties and said second locations are at waist portion of said front panel of said bikini bottom or said panties.

* * * * *